US010150923B2

(12) United States Patent
Rehm et al.

(10) Patent No.: US 10,150,923 B2
(45) Date of Patent: Dec. 11, 2018

(54) THREE-PHASE SEPARATION OF HYDROCARBON CONTAINING FLUIDS

(71) Applicant: John Zink Company, LLC, Tulsa, OK (US)

(72) Inventors: Stephen Joseph Rehm, Tulsa, OK (US); Timothy Warren Oneal, Tulsa, OK (US); Gene Wesley Bittel, Tulsa, OK (US); Mark Elliot Ferguson, Tulsa, OK (US); Daniel Todd Wright, Tulsa, OK (US); Nicholas Lee Jensen, Tulsa, OK (US); Todd Ethan Earls, Tulsa, OK (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 15/929,034

(22) Filed: Jul. 17, 2018

(65) Prior Publication Data

US 2018/0320090 A1 Nov. 8, 2018

Related U.S. Application Data

(60) Continuation of application No. 15/685,851, filed on Aug. 24, 2017, which is a division of application No. 15/426,802, filed on Feb. 7, 2017, now Pat. No. 9,828,556.

(60) Provisional application No. 62/413,079, filed on Oct. 26, 2016.

(51) Int. Cl.

| | |
|---|---|
| ***C10G 33/00*** | (2006.01) |
| ***C10G 7/00*** | (2006.01) |
| ***C10G 31/06*** | (2006.01) |

(52) U.S. Cl.

CPC ..... *C10G 33/00* (2013.01); *C10G 7/00* (2013.01); *C10G 31/06* (2013.01); *C10G 2300/208* (2013.01)

(58) Field of Classification Search

None

See application file for complete search history.

(56) References Cited

U.S. PATENT DOCUMENTS

| | | | | | |
|---|---|---|---|---|---|
| 3,407,805 | A | * | 10/1968 | Bougard | F22B 1/26 126/360.2 |
| 4,778,443 | A | * | 10/1988 | Sands | C10G 33/06 494/31 |
| 4,948,393 | A | * | 8/1990 | Hodson | B01D 17/00 95/250 |
| 5,302,294 | A | * | 4/1994 | Schubert | B01D 17/02 210/188 |
| 6,132,494 | A | * | 10/2000 | Kjos | B04C 5/081 95/243 |

(Continued)

FOREIGN PATENT DOCUMENTS

WO 2005094961 A1 10/2005

*Primary Examiner* — Duane Smith
*Assistant Examiner* — Phillip Y Shao

(57) ABSTRACT

The methods improve the separation of hydrocarbon containing fluids. More particularly, the disclosure is relevant to separating fluids having a gas phase, a hydrocarbon liquid phase, and an aqueous liquid phase using indirect heating. In general, the methods use a first three-phase gas separation stop followed by indirect heating and then a second three-phase gas separation step. Pressure reduction of the hydrocarbon containing fluid occurs either before or after the indirect heating.

13 Claims, 8 Drawing Sheets

(56) References Cited

U.S. PATENT DOCUMENTS

| | | | | |
|---|---|---|---|---|
| 6,968,901 | B2 * | 11/2005 | Edmondson | B01D 19/0042 166/357 |
| 7,014,757 | B2 * | 3/2006 | Rhodes | B01D 17/00 210/188 |
| 7,347,945 | B2 * | 3/2008 | Amado | B01D 17/0211 210/739 |
| 7,740,691 | B2 * | 6/2010 | Cash | B01D 53/1462 261/126 |
| 7,871,526 | B2 * | 1/2011 | Allouche | B01D 17/0211 210/739 |
| 8,491,796 | B2 * | 7/2013 | Perez-Cordova | B01D 17/042 210/708 |
| 9,630,126 | B1 * | 4/2017 | Ball | B01D 17/0211 |

* cited by examiner

THREE-PHASE SEPARATION OF HYDROCARBON CONTAINING FLUIDS

CROSS-REFERENCE TO RELATED APPLICATIONS

This application is a continuation of U.S. Non-Provisional application Ser. No. 15/685,851 filed on Aug. 24, 2017, now allowed, which is a divisional of U.S. Pat. No. 9,828,556 issued on Nov. 28, 2017, which claims the benefit of U.S. Provisional Application No. 62/413,079 filed Oct. 26, 2016, which are hereby incorporated by reference.

FIELD

This disclosure relates to systems and methods for separation of hydrocarbon containing fluids. More particularly, the disclosure is relevant to separating fluids having a gas phase, a hydrocarbon liquid phase, and an aqueous liquid phase.

BACKGROUND

Most formations bearing hydrocarbons simultaneously produce an oil phase, a gas phase and an aqueous phase, usually brine. Several wells can be tied together through a gathering line into a separation or processing plant, sometimes comprising just a simple tank, where initial gravity separation of water, oil and gas occurs. Theoretically, gas is taken from the top, water and sediments are drawn from the bottom, and the oil is drawn from the middle of the mixture. In practice, such separations have generally involved the direct heating of the hydrocarbon feed to achieve better separation of the three phases (the gas phase, the lighter hydrocarbon liquid or oil, and the heavier aqueous liquid). Unfortunately, when using conventional systems for separating the three phases, it can be difficult and costly to meet vapor pressure specifications. Accordingly, new techniques for better meeting vapor pressure specifications are of interest in the industry.

SUMMARY OF THE INVENTION

As disclosed herein, systems and methods for separation of hydrocarbon containing fluids are provided. Such systems and methods work to provide a superior solution for separating a three-phase feed having a gas phase, an aqueous liquid phase, and a hydrocarbon phase. The gas phase typically comprises a gaseous light hydrocarbon. The aqueous liquid phase generally comprises water, saltwater or brine, such as produced water from oil production operations. The hydrocarbon liquid phase is typically composed of hydrocarbons that are in a liquid state at temperatures from about 32° F. to about 150° F. at standard pressure. While the invention has wider applicability, a typical area where it is useful is in separating gaseous hydrocarbons and aqueous liquid entrained in a hydrocarbon feed from a producing oil well.

In one aspect, the present disclosure provides a process comprising introducing a first fluid into a first separation zone at a first pressure and a first temperature, wherein the first fluid comprises an aqueous liquid, a hydrocarbon liquid and a gas; separating a first portion of the gas and a first portion of the aqueous liquid from the first fluid in the first separation zone to produce a second fluid having a higher concentration of hydrocarbon liquid than the first fluid; indirectly heating the second fluid to a second temperature greater than the first temperature but below the saturation temperature of the aqueous liquid; reducing the pressure of the second fluid to a second pressure below the first pressure; and separating a second portion of the gas and a second portion of the aqueous liquid from the second fluid in a second separation zone to produce a third fluid having a higher concentration of hydrocarbon liquids than the second fluid. The pressure reduction step can occur after indirect heating of the second fluid, or before indirect heating of the second fluid. Further, the third fluid can be at a pressure equal to or less than the second pressure, and at a third temperature equal to or less than said second temperature.

In some embodiments, the first temperature of the process can be below 100° F. Optionally, the first temperature can be about ambient, about 32° F. to less than 100° F.; from about 50° F. to about 90° F.; or from 60° F. to 85° F. The second temperature can be above 100° F. The first pressure can be greater than 100 psig. The second pressure can be less than about 20 psig and optionally less than about 15 psig, less than about 12 psig, or less than about 10 psig.

In some embodiments, the third fluid can comprise less than 1% by volume aqueous liquid and less than 1% by volume gas, and optionally the third fluid can comprise less than 0.5% by volume aqueous liquid and less than 0.5% by volume gas, the third fluid can comprise less than 0.1% by volume aqueous liquid and less than 0.1% by volume gas, or the third fluid can be essentially free of aqueous liquid and gas.

Some embodiments use an indirect heating method carried out by the steps of introducing hot effluent gases from a burner into a fire-tube at least partially submerged in a bath fluid to thus heat the bath fluid, contacting the thus heated bath fluid with a coil, and introducing the second fluid into the coil to thus flow through the coil such that it is heated by the heated bath fluid.

Some embodiments use a separating method for the second separation zone comprising:

- introducing the second fluid into the second separation zone above a series of baffles such that the second fluid encounters the baffles, thus enhancing the separation of the second portion of the gas from the second fluid;
- subsequently introducing the second fluid to the bottom of the separation zone such that the hydrocarbon liquid in the second fluid rises to a mid-portion of the separation zone and the second portion of the aqueous liquid remains at the bottom of the separation zone;
- removing the second portion of the gas from the top of the separation zone;
- removing the second portion of the aqueous liquid from the bottom of the separation zone; and
- removing the hydrocarbon liquid from the mid-portion of the separation zone as the third fluid.

In another aspect, the present disclosure provides a system for separating aqueous liquid and a gas from a hydrocarbon feed. The system comprises a first three-phase separator wherein a first portion of the aqueous liquid and a first portion of the gas are separated from hydrocarbon feed to produce a first hydrocarbon-enriched stream; an indirect heater which receives and indirectly heats the first hydrocarbon-enriched stream; and a second three-phase separator wherein a second portion of the aqueous liquid and a second portion of the gas are separated from the thus heated hydrocarbon-enriched stream to produce a second hydrocarbon-enriched stream. The system can further include a pressure reducer that reduces the pressure of the first hydrocarbon-enriched stream. The location of the pressure reducer can be upstream of the second three-phase separator and downstream of the first three-phase separator. Additionally, the pressure reducer can be upstream of the indirect heater or downstream of the indirect heater.

The indirect heater of the system can comprise a burner, a container, a fire-tube and a coil. The container can hold a bath liquid. The fire-tube at least partially extends through the container and is connected to the burner such that hot gaseous effluent flows through the fire-tube and thus heats the bath liquid. The coil extends at least partially through the container. The coil is configured to receive the first hydrocarbon-enriched stream, which is thus heated by the contact of the coil with the bath liquid.

In some embodiments, the system can also comprise a two-phase separator located upstream from the first three-phase separator. The two-phase separator is configured to remove part of the gas from the feed stream prior to introduction to the first three-phase separator.

In some embodiments, the second three-phase separator of the system comprises a vessel. The vessel has a top portion, a bottom portion, a mid-portion, a partition and a downcomer. The top portion contains a series of baffles and has a first hydrocarbon-enriched stream inlet and a gas outlet. The bottom portion has a bottom and an aqueous fluid outlet. The mid-portion has a hydrocarbon fluid outlet. The partition is located in the mid-portion above the hydrocarbon fluid. The partition separates the top portion from the bottom portion. The downcomer is configured to introduce liquids from the top portion to the bottom of the bottom portion.

BRIEF DESCRIPTION OF THE DRAWINGS

FIG. 5 illustrates the control aspects of the system and process.

FIG. 6 is a diagrammatic illustration of a prior art system for separation of a hydrocarbon feed stream.

DESCRIPTION

Figure 1:
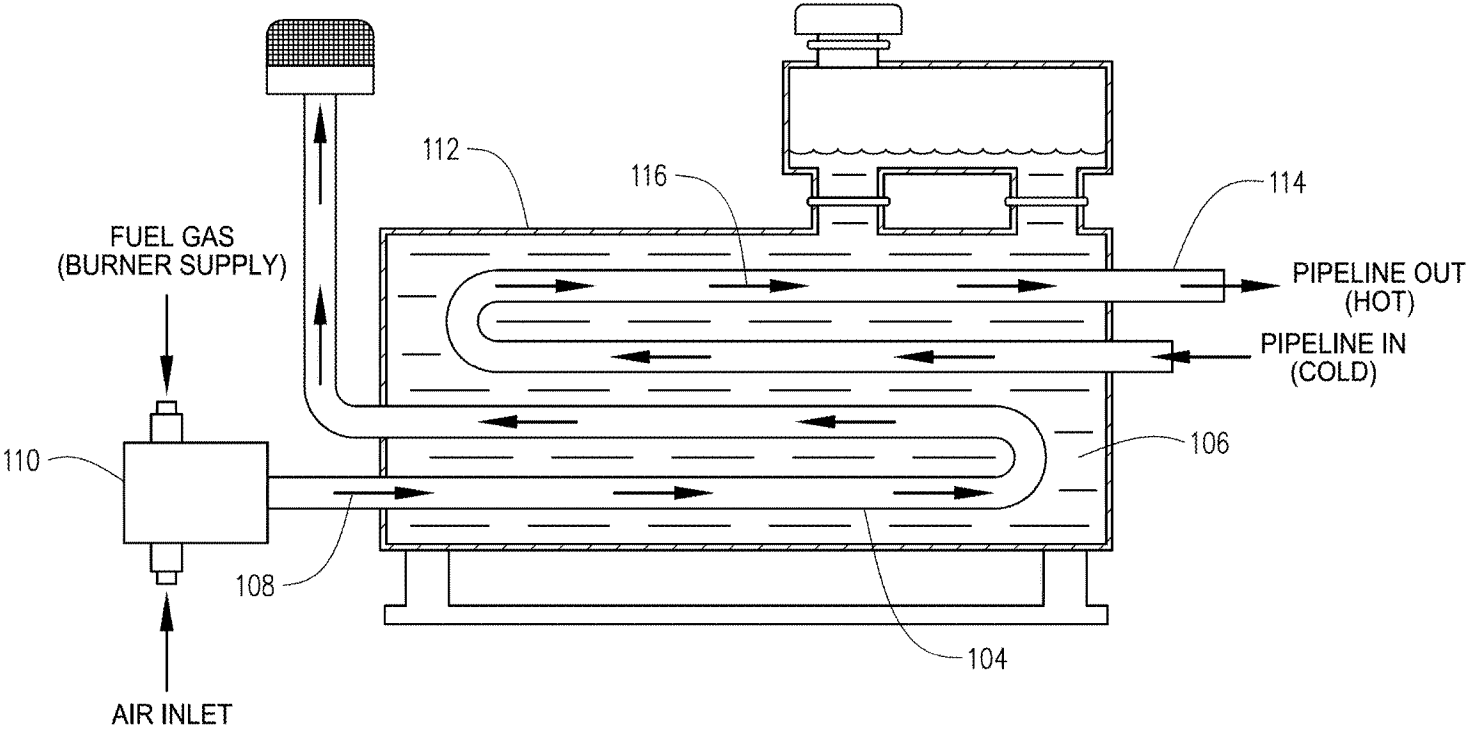
FIG. 1 is a schematic representation of an indirect heater as might be used in some embodiments.

The present disclosure may be understood more readily by reference to the following description including the examples. In addition, numerous specific details are set forth in order to provide a thorough understanding of the embodiments described herein. However, those of ordinary skill in the art will understand that the embodiments described herein can be practiced without these specific details. In other instances, methods, procedures and components have not been described in detail so as not to obscure the related relevant feature being described. Additionally, the description is not to be considered as limiting the scope of the embodiments described herein.

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. Where components of relatively well-known designs are employed, their structure and operation will not be described in detail. One of ordinary skill in the art will appreciate the many possible applications and variations of the present invention based on the following description.

The following describes a system of equipment whose individual benefits work to provide a superior solution for separating a three-phase feed having a gas phase, an aqueous liquid phase, and a hydrocarbon liquid phase. The gas phase typically comprises a gaseous light hydrocarbon, such as methane, ethane, propane, butane and the like. Generally, as used herein, gaseous light hydrocarbons are ones in a gaseous state at temperatures from about 32° F. to about 150° F. at standard pressure. The gas phase can also include non-hydrocarbons that are gaseous in the aforementioned temperature range, for example carbon dioxide and sulfur dioxide.

The aqueous liquid phase generally comprises water, saltwater or brine, such as produced water from oil production operations. The hydrocarbon liquid phase is typically composed of hydrocarbons that are in a liquid state at temperatures from about 32° F. to about 150° F. at standard pressure. While the invention has wider applicability, a typical area where it is useful is in separating gaseous hydrocarbons and aqueous liquid entrained in a hydrocarbon feed from a producing oil well.

The system in its most simple form is a separator followed by an indirect heater followed by another separator. There may be up or downstream equipment associated with this unit, most commonly, an upstream high-pressure gas separator to remove gaseous hydrocarbons from the hydrocarbon feed stream for sale.

As used herein, "direct heater" and "direct heating" refer to a style of heating where hot burner gases directly heat the treatment stream, typically process liquid or process gas. For example, a burner provides hot gasses that transfer their heat energy to the treatment stream flowing directly through coils installed inside the heater vessel. Alternatively, the hot gases may be introduced into a fire-tube, which is submerged in the treatment stream such that the treatment stream flows around the fire-tube and is thus heated. In this disclosure, the treatment stream is a three-phase hydrocarbon feed for separation.

As used herein "indirect heater" or "indirect heating" refers to a style of heating in which an intermediary bath liquid is directly heated by the hot burner gases and then the bath liquid is used to heat the treatment stream. For example, FIG. 1 illustrates an indirect heater 102. In FIG. 1, a fire-tube 104 is submerged in a bath liquid 106 such that bath liquid 106 is heated by hot burner gases 108 flowing through fire-tube 104. The indirect heater of FIG. 1 comprises a burner 110, a container 112, a fire-tube 104 and a coil 114. Container 112 holds bath liquid 106. Fire-tube 104 at least partially extends through container 112 so as to be submerged in bath liquid 106. Fire-tube 104 is connected to burner 110 such that hot burner gases 108 flow through fire-tube 104 and thus heats bath liquid 106. Coil 114 extends at least partially through container 112. Coil 114 is configured to receive the treatment stream 116, which is thus heated by contact of coil 114 with bath liquid 106. Thus, heated bath liquid 106 is used to heat treatment stream 116 by flowing treatment stream 116 through coil 114, which is submerged in heated bath liquid 106. Bath liquid 106 will often be water or a mixture of water and glycol.

Figure 2:
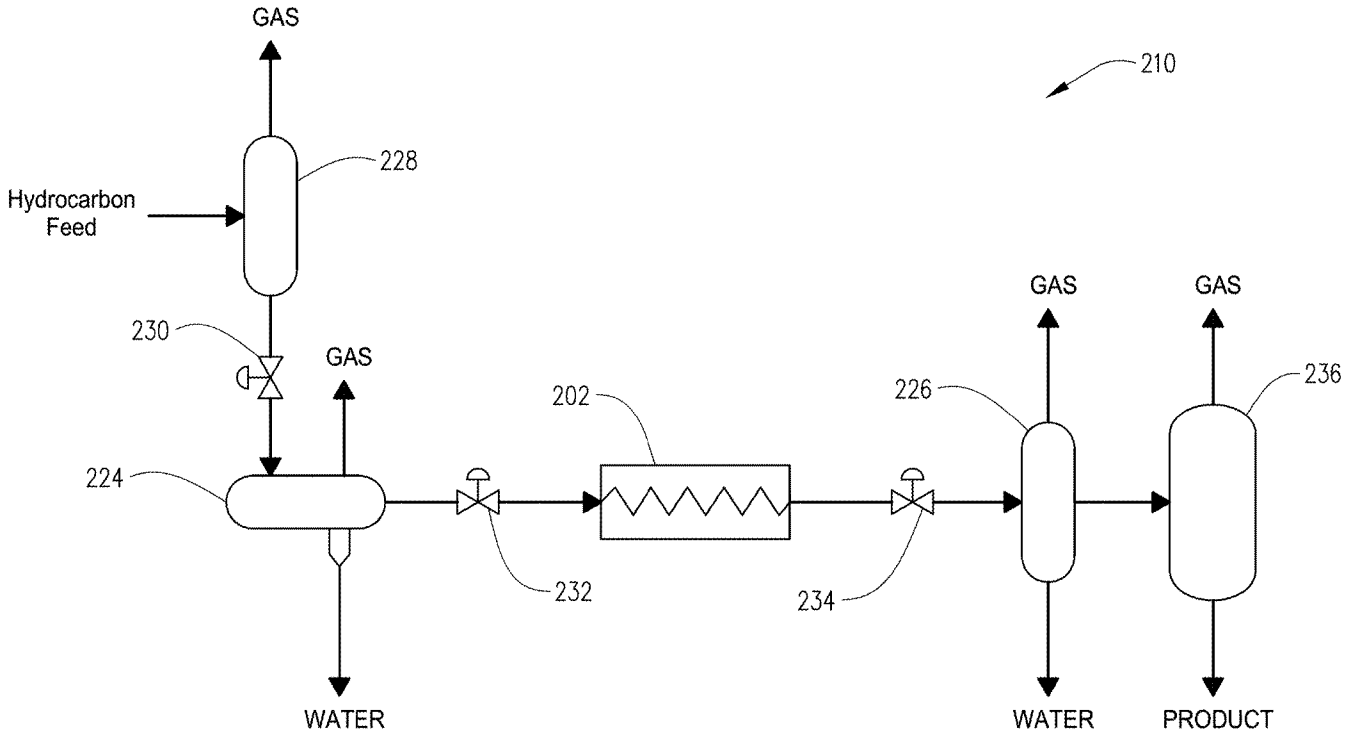
FIG. 2 is a schematic illustration of a system for carrying out a process for separating a three-phase feed in accordance with one embodiment.

Turning now to FIG. 2, the schematic representation of a system 210 to carry out the process is illustrated. In its broadest embodiment, system 210 comprises a first three-phase separator 224, an indirect heater 202 and a second three-phase separator 226. Three-phase separators are separators wherein a feed comprising a gas phase and a lighter liquid and a heavier liquid phase are separated into the three phases: gas, lighter liquid and heavier liquid. Such a separator is also called a gas/liquid/liquid separator. Three-phase separators are used in the oil industry to separate mixtures of hydrocarbons (gas and oil, and water) into the constituent gas, oil and water.

Optionally, a two-phase separator 228 can be utilized prior to first three-phase separator 224. Two-phase separator 228 is a separator where a feed stream is separated into two phases: gas and liquid. As illustrated, two-phase gas separator 228 can be utilized to separate part of the gas phase out from a high-pressure hydrocarbon feed stream having three phases. The gas phase portion separated out is typically rich in gaseous hydrocarbons and can be sold as a product.

Flow from two-phase separator 228 can be controlled by level control valve 230. Additionally, the pressure of the remaining three-phase feed can then be reduced at level control valve 230 and subsequently introduced into first three-phase separator 224. In first three-phase separator 224, a first portion of the aqueous liquid phase and a first portion of the gas phase are separated from hydrocarbon feed to produce a first hydrocarbon-enriched stream, that is a stream now richer in the liquid hydrocarbon phase. The first portion of the aqueous liquid phase can be disposed of as waste. The first portion of the gas phase can generally be sent to a flare to be burned as waste.

The first hydrocarbon-enriched stream is then sent to indirect heater 202, which indirectly heats the first hydrocarbon-enriched stream by use of a liquid bath as described above. Typically, the pressure of the first hydrocarbon-enriched stream can be reduced in pressure reducer 232 prior to introduction into indirect heater 202. This pressure reduction helps achieve the advantages attributed to lower heater duty. However, in some embodiments the pressure can be reduced after indirect heating by pressure reducer 234. In other embodiments, the pressure can be reduced both by pressure reducer 232 and 234. The use of indirect heat advantageously allows for one or both of the pressure reducers 232 and 234. Specifically, indirect heater 202 is placed near (e.g. ~20 ft.) or in-line with the separators 224 and 226, which takes advantage of pressure reducers 232 and 234 without significant loss of heat or pressure drop through the piping. Conversely, a direct heater is usually installed outside the explosion limits (e.g. ~200 feet), which requires significant heat duty to maintain proper temperature and results in high-pressure drop through the piping.

Next, the heated first hydrocarbon-enriched stream is introduced into second three-phase separator 226, wherein a second portion of the aqueous liquid phase and a second portion of the gas phase are separated from the thus heated hydrocarbon-enriched stream to produce a second hydrocarbon-enriched stream. The second portion of the aqueous liquid phase can be disposed of as waste. The second portion of the gas phase can generally be sent to flare to burn as waste. The second hydrocarbon-enriched stream can be sent to a tank 236 for storage.

Figure 3:
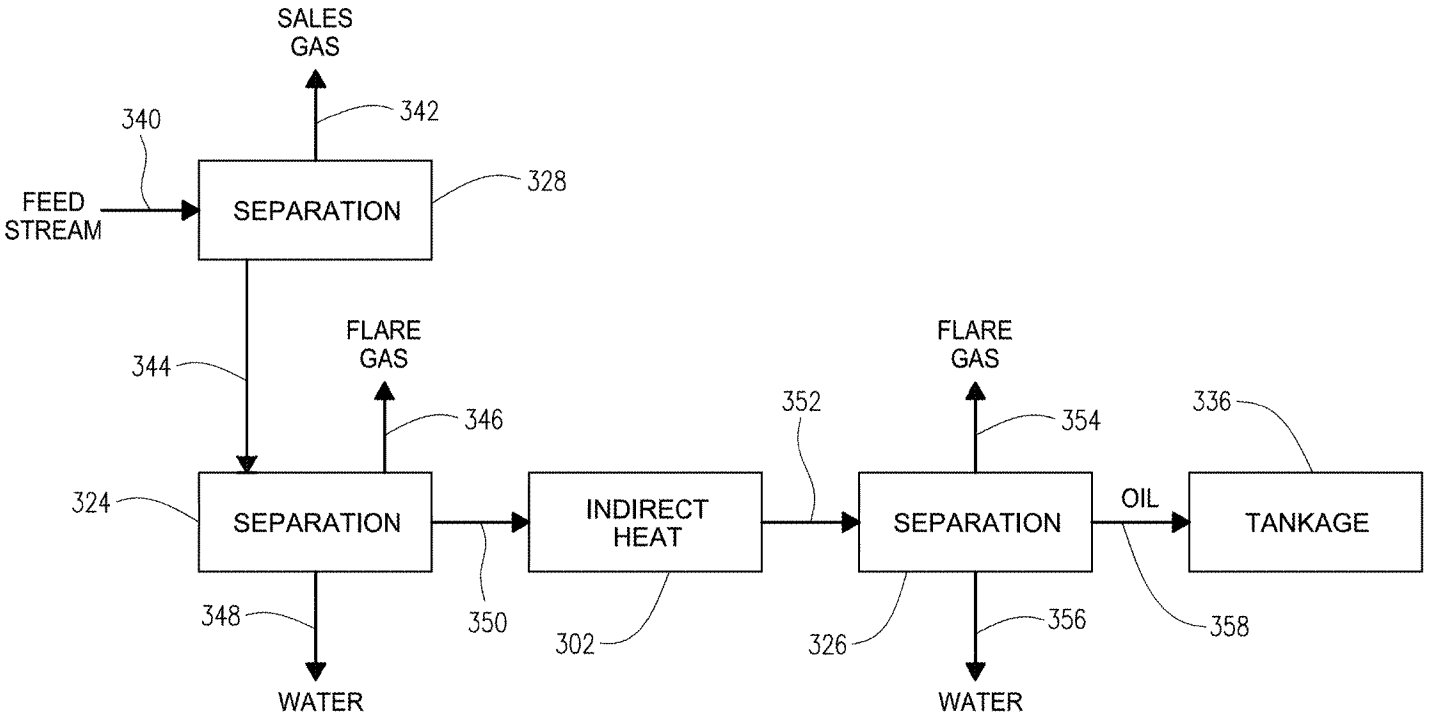
FIG. 3 is a schematic diagram of the process for separating a three-phase feed in accordance with one embodiment.

The process will be further described with reference to a general schematic diagram of FIG. 3. As illustrated, an initial three-phase feed stream 340 is introduced into optional two-phase separator or separation zone 328 to separate a part of the gas phase from the two liquid phases. Generally, feed stream 340 can be a pressurized feed stream having a pressure greater than 100 psig. Feed stream 340 will generally have a first temperature that is about ambient, typically from 32° F. to less than 100° F., more typically from 50° F. to 90° F., and in some cases from 60° F. to about 85° F. The pressure of feed stream 340 typically is not reduced prior to entering the two-phase separation. Sales gas 342 taken off during this separation will typically be rich in hydrocarbons and thus can be sold as a product.

The remaining portion of the feed stream from the two-phase separator generally still comprises two liquid phases and a gas phase, although the quantity of the gas phase has been reduced. This fluid stream 344 is introduced into a first three-phase separation zone 324. Fluid stream 344 can be introduced to first three-phase separation zone 324 without a pressure reduction, hence at a pressure of greater than 100 psig. However, generally the pressure of fluid stream 344 can be reduced prior to introduction into first three-phase separation zone 324. The pressure can be reduced to a pressure below 100 psig but above near atmospheric pressure (as described below); thus, will be at a mid-pressure. Generally, the mid-pressure is at least about 17 psig, and more typically at least about 20 psig or at least about 25 psig, and the mid-pressure generally is no greater than about 90 psig, and more typically no greater than about 70 psig. While the temperature at which fluid stream 344 is introduced into first three-phase separation zone 324 can be cooler than feed stream 340, which entered two-phase separation zone 328, generally fluid stream 344 is still about ambient as described above. In most embodiments, fluid stream 344 will not be heated prior to introduction into first three-phase separation zone 324 and will not be heated during separation within first three-phase separation zone 324. The temperature of the fluid stream 344 may undergo slight cooling from separation of the phases in first three-phase separation zone 324.

Within first three-phase separation zone 324, a portion of the gas and a portion of the aqueous liquid (indicated by water in FIG. 3) are separated from fluid stream 344 to produce an enriched fluid stream 350 having a higher concentration of hydrocarbon liquid than fluid stream 344 entering the first three-phase separation zone 324.

Enriched fluid stream 350 is introduced into the indirect heater (indirect heating zone) 302 so that it is indirectly heated to a second temperature greater than the first temperature but below the saturation temperature of the aqueous liquid. The saturation temperature is the temperature for a corresponding saturation pressure at which a liquid boils into its vapor phase. The liquid can be said to be saturated with thermal energy. The second temperature can depend on the composition of the enriched fluid stream and the pressure at which heat is applied. Typically, the second temperature is above 100° F. and, in some embodiments, up to about 160° F.

Generally, prior to indirect heating of enriched fluid stream 350, the pressure of enriched fluid stream 350 can be further reduced to near atmospheric pressure. "Near atmospheric" means a pressure just high enough to overcome the head losses of the indirect heater 302 and the piping to drive the fluid from indirect heater 302 into second three-phase separator 326, as described below. Near atmospheric pressure is close to, typically within about 10 psi of, the surrounding atmospheric pressure but less than the mid-pressure and the pressure of the initial feed stream. More generally, this is from about 0 psig to about 20 psig, more typically from about 5 psig to about 15 psig or from about 7 psig to about 12 psig and often about 10 psig or less. Reducing the pressure prior to indirect heating is believed to advantageously lessen the heater duty; thus reducing system demands and cost. However, it is within the scope of this disclosure to reduce the pressure to near atmospheric after indirect heating. Also, it is within the scope to step-wise reduce the pressure around the indirect heating; that is, to reduce the pressure between first three-phase separation zone 324 and indirect heater 302 to a pressure above near atmospheric and then further reducing the pressure between indirect heater 302 and second three-phase separation zone 326 to near atmospheric.

The resulting near-atmospheric heated fluid stream 352 is introduced into a second three-phase separator 326, wherein a second portion of the gas phase and a second portion of the aqueous liquid phase (water in FIG. 3) are separated from the heated fluid stream 352. At this stage, the remaining fluid stream 358 is substantially hydrocarbon liquid phase with only negligible amounts of gas phase or aqueous liquid phase. Generally, remaining fluid stream 358 comprises less than 1% by volume aqueous liquid phase and less than 1% by volume gas phase. More typically, remaining fluid stream 358 comprises less than 0.5% by volume aqueous liquid phase and less than 0.5% by volume gas phase, or less than 0.1% by volume aqueous liquid phase and less than 0.1% by volume gas phase, or remaining fluid stream 358 is essentially free of aqueous liquid and gas. Remaining fluid stream 358 can then be sent to tank 336 for storage until shipped or sold. Thus, the combination of the various elements in this process, such as indirect heating and final three-stage separation at near atmospheric pressure allows for minimal heat loss and achieves a product in tank 336 which has essentially no aqueous liquid component or gas component.

Figure 4A:
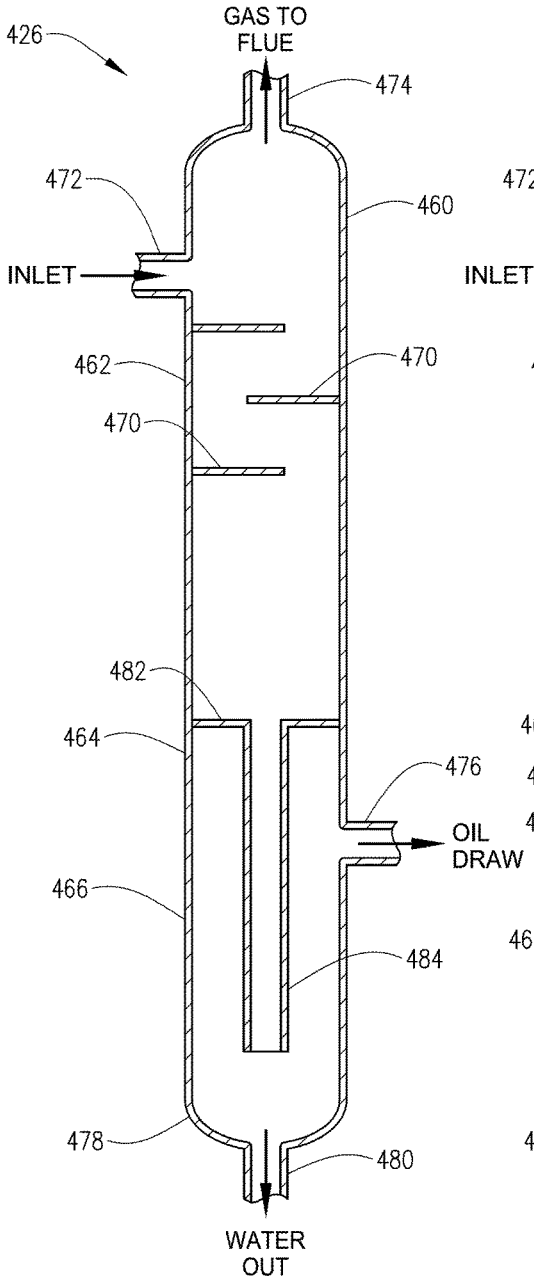
FIG. 4A is a schematic illustration of a three-phase separator that can be used in the system of FIG. 2.

Turning now to FIG. 4A, a separator 426 suitable for use as a three-phase separator in the process is illustrated. For example, the illustrated separator can be used as the second three-phase separator. Separator 426 comprises a vessel 460 defining a separation zone having a top portion 462, a mid-portion 464 and a bottom portion 466. Top portion 462 contains a series of baffles 470 and has a fluid stream inlet 472 and a gas outlet 474. Mid-portion 464 has a hydrocarbon fluid outlet 476. Bottom portion 466 has a bottom 478 and an aqueous fluid outlet 480.

A partition 482 is located in mid-portion 464 above the hydrocarbon fluid outlet 476. Partition 482 separates top portion 462 from bottom portion 466. A downcomer 484 protrudes through partition 482 and is configured to introduce liquids from top portion 462 to the bottom 478 of bottom portion 466.

Figure 4B:
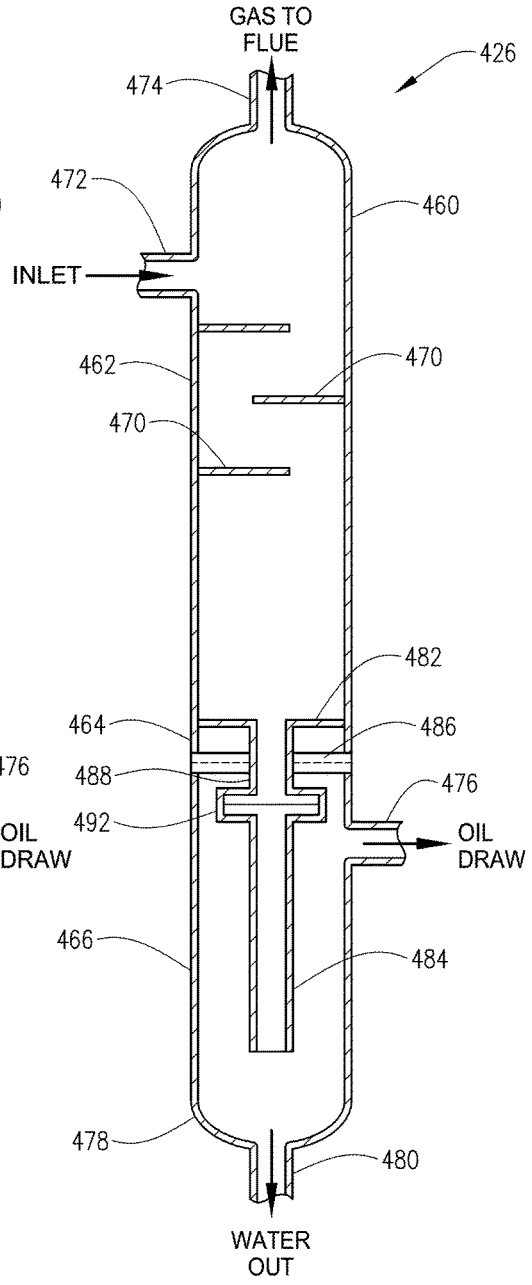
FIG. 4B is a schematic illustration of an alternative embodiment of a three-phase separator that can be used in the system of FIG. 2.

As illustrated in FIG. 4B, in some embodiments, bottom portion 466 is connected to mid-portion 464 by a flange connection 486. Additionally, downcomer 484 can have a top portion 488 and a lower portion 490, which are connected by a flange connection 492. This allows for a swap out of bottom portion 466 to provide for different sizes of the bottom portion to accommodate different size tankage and to adjust to the dimensions at the field site.

The operation of the illustrated three-phase separator 426 comprises introducing a three-phase fluid stream from the indirect heater into vessel 460 through fluid stream inlet 472 located above the series of baffles 470 such that the fluid stream encounters baffles 470 thus enhancing the separation of the gas phase from the fluid stream. Subsequently, the liquid portion of the fluid stream settles down towards mid-portion 464 and encounters partition 482 and downcomer 484 such that the liquid portion is introduced to the bottom portion 466 of the separation zone through downcomer 484. At the bottom 478 of the separation zone, the hydrocarbon liquid phase rises to mid-portion 464 of the separation zone below partition 482, and the aqueous liquid phase remains at the bottom 478 of the separation zone. The gas phase is removed from the gas outlet 474 at the top of the separation zone. The aqueous liquid phase is removed from the aqueous liquid outlet 480 at the bottom 478 of the separation zone. The hydrocarbon liquid phase is removed from mid-portion 464 of the separation zone below partition 482.

The above described system and process allows for greater control of the process and resulting product. Control of the process and system can be appreciated with reference to FIG. 5. The control process illustrated can be either performed manually or automated.

Figure 5:
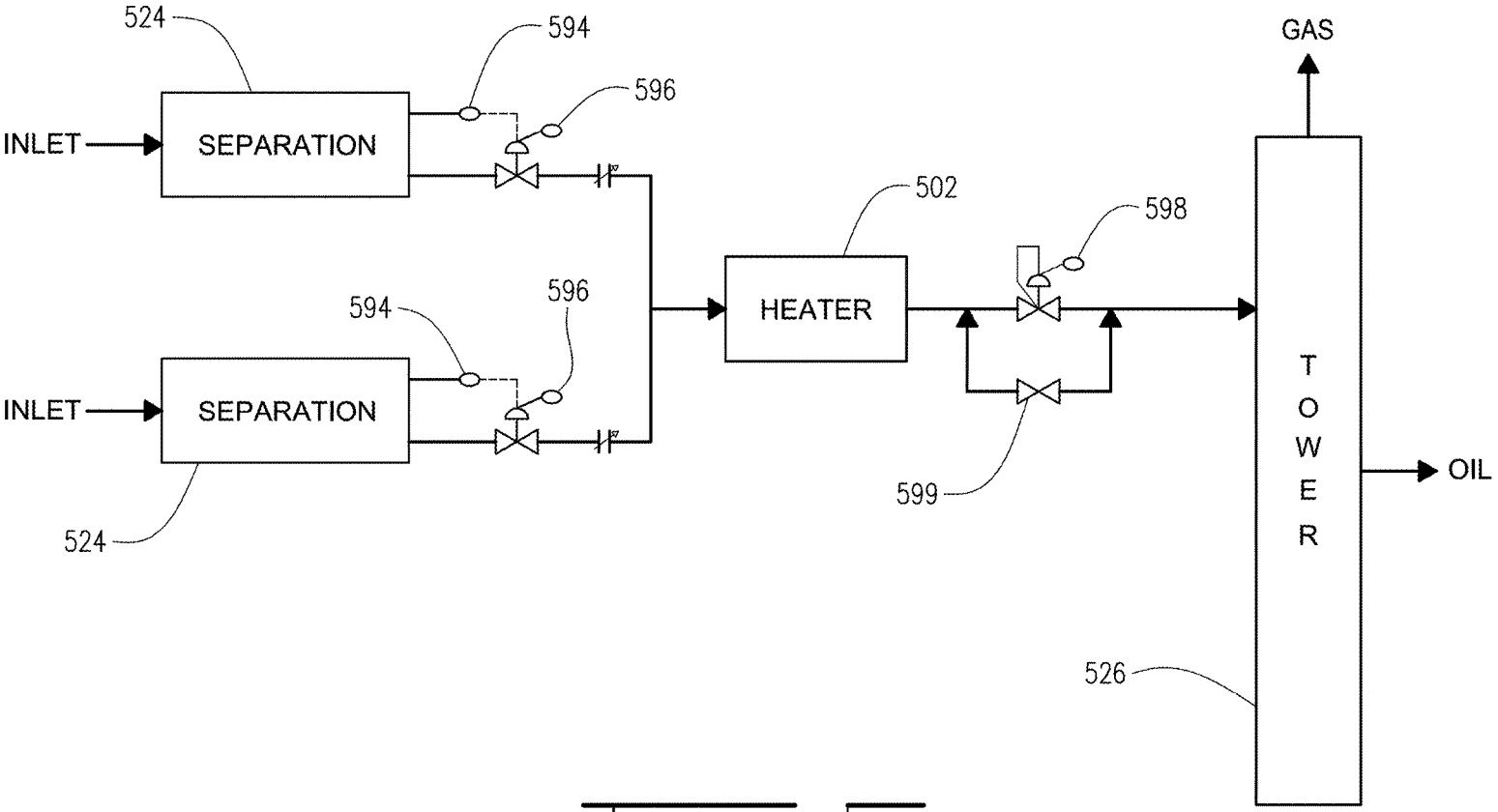
FIG. 5 is a schematic illustration of a system according to some embodiments of this disclosure.
Figure 5:
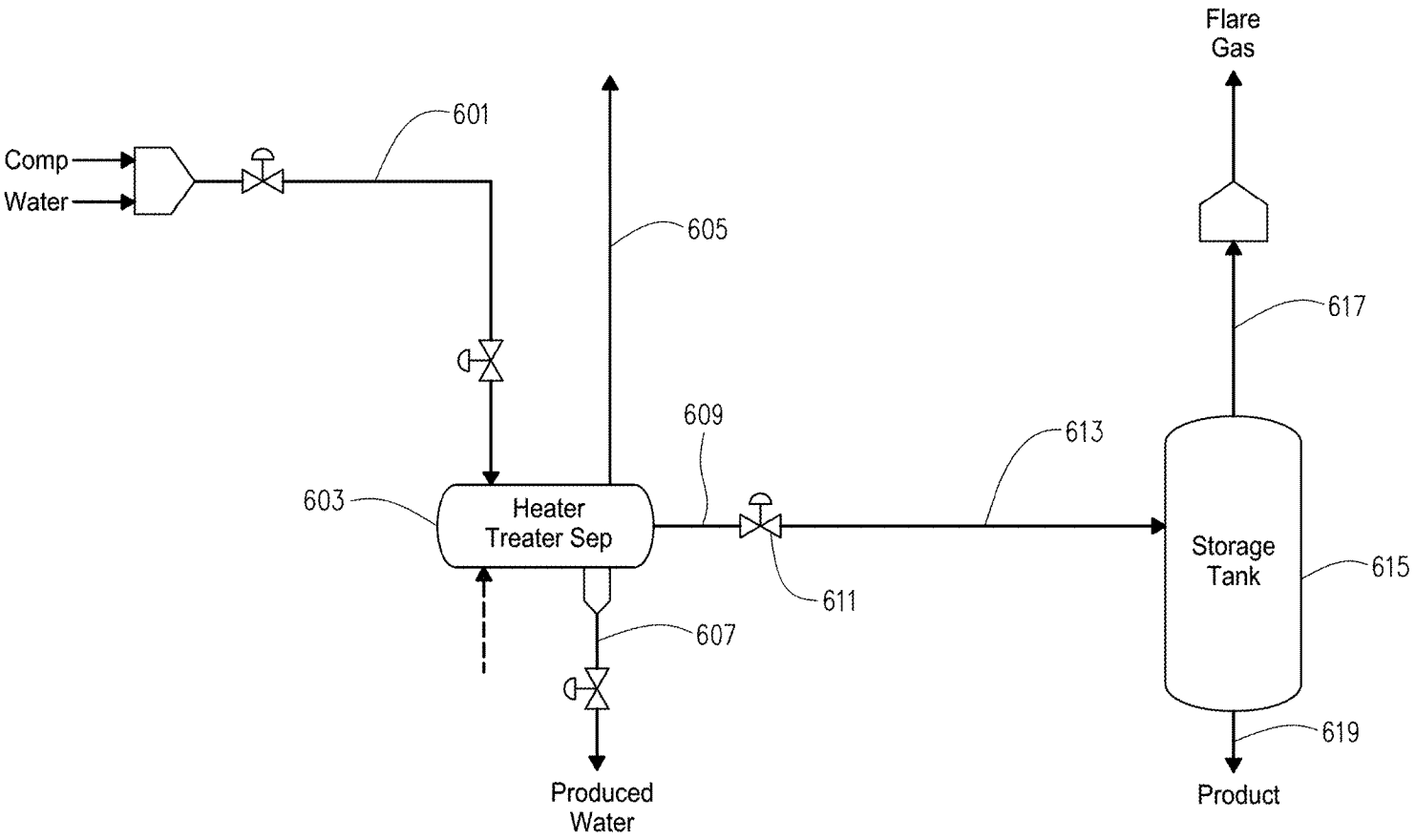
FIG. 5 PRIOR ART

For example, Reid vapor pressure (RVP) specification can be better met by adjusting the processes to utilize near atmospheric pressure at the indirect heater and in the second three-phase separator (labeled as the "Tower" in FIG. 5). For RVP spec, the level control (LC) 594 on each of the first three-phase separators 524 can maintain desired levels and allow the hydrocarbon stream from first three-phase separators 524 to dump through a level control valve (LCV) 596 as levels increase. Manual bypass valve 599 will be in the open position and a pressure control valve (PCV) 598 will be closed allowing indirect heater 502 to operate at the pressure of second three-phase separator 526 plus head pressure or at near atmospheric pressure. The pressure change will happen at LCV 596.

As a second example, temperature specifications can be better met by adjusting the system so that indirect heater 502 is run at a higher pressure with pressure reduction occurring between indirect heater 502 and second three-phase separator 526. In this configuration, level control (LC) 594 on each of the first three-phase separators 524 can maintain desired levels and allow the hydrocarbon stream from the first three-phase separators 524 to dump through LCV 596 as levels increase. Manual bypass valve 599 will be in the closed position and PCV 598 will modulate to maintain a backpressure to allow indirect heater 502 to operate near the pressure of the first three-phase separators 524 with minimal pressure drop to only insure adequate flow. For example, for first three-phase separators 524 operating at about 50 psig, backpressure can be about 45 psig. The pressure change to near atmospheric will happen at PCV 598, so that the fluid stream entering second three-phase separator 526 is at near atmospheric pressure.

There are more advanced methods which can be utilized to control the system and process. For example, the system can be automated by using LIC (level indicator controllers or liquid level controllers), PID controllers, PIC controllers, programmable logic controllers (PLC), processors and the like, to detect liquid levels, pressures and temperatures and to adjust the valves accordingly.

For example, RVP specification can be met by using LIC at level control (LC) 594 on each of the first three-phase separators 524 to measure the level and deliver an input signal back to a PLC with LIC logic/PID control to deliver an output signal to LCV 596 to maintain desired level and allow the hydrocarbon stream from the first three-phase separators 524 to dump at a steady dump rate. Manual bypass valve 599 will still be in place but will no longer need to be used to achieve near atmospheric pressure. The PLC will adjust PCV 598 to the open position allowing the indirect heater 502 to operate at the pressure of second three-phase separator 526 plus head pressure, or near atmospheric pressure. Pressure change will happen at LCV 596.

For temperature specification operation, the LIC at the level control (LC) on each separator can measure the level and deliver an input signal back to a PLC with LIC logic/PID control to deliver an output signal to LCV 596 to maintain the desired level set point and allow the hydrocarbon stream from the first three-phase separators 524 to dump at a steady dump rate. Manual bypass valve 599 will still be in place but will no longer need to be used. A pressure transmitter can measure the upstream pressure of PCV 598 and deliver an input signal back to a PLC with PIC logic/PID control to deliver an output signal to PCV 598 to modulate so as to maintain a desired pressure set point (back pressure) and allow indirect heater 502 to operate near the pressure of the first three-phase separators 524 with minimal pressure drop to insure adequate flow. The pressure change to near atmospheric will happen at PCV 598.

With the use of automated logic control, the system has the opportunity to start utilizing advanced measurement devices to continually optimize the oil treating process to meet RVP specification and temperature specification simultaneously to achieve maximum oil production and optimizing the system control itself.

Figure 8:
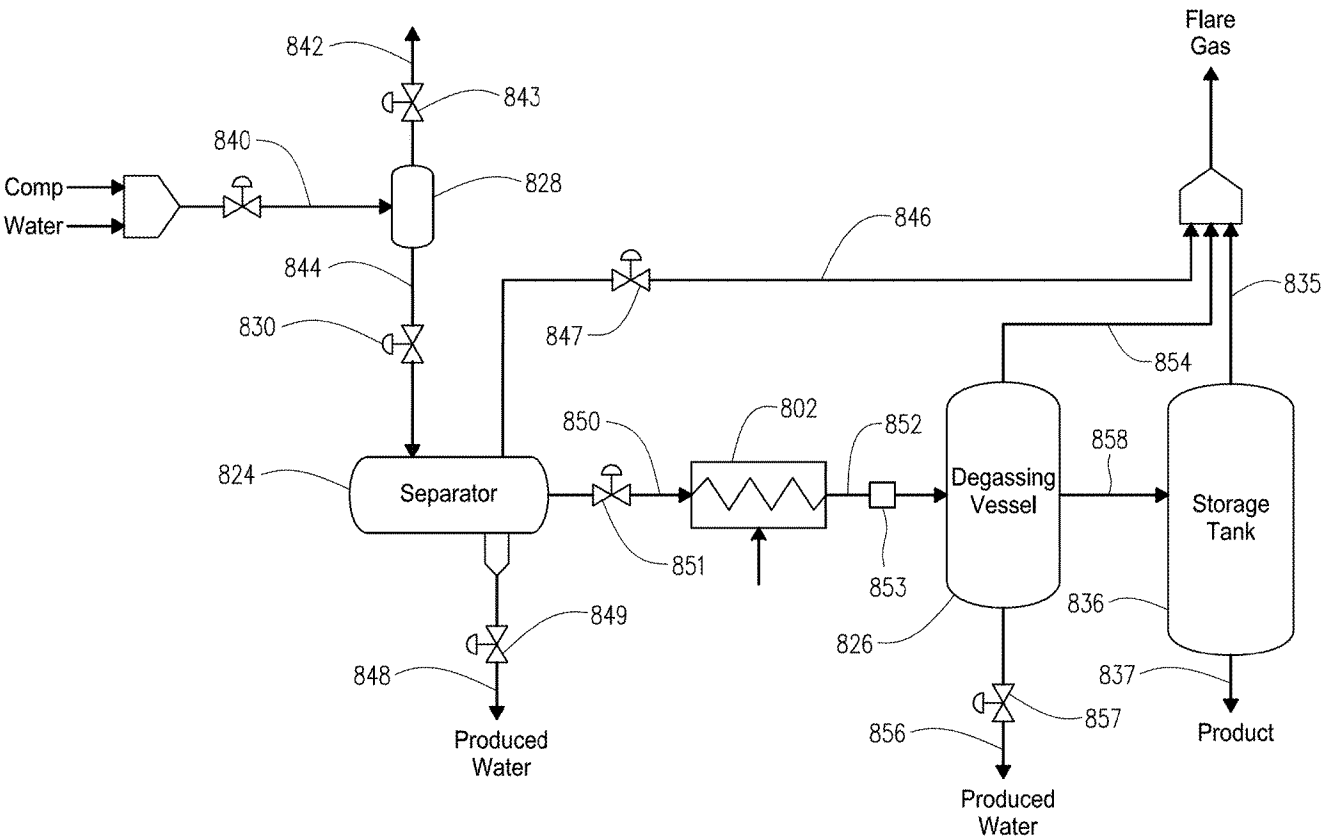
FIG. 8 is a diagrammatic illustration of a system for separation of a hydrocarbon feed stream in accordance with one embodiment of the current description.

One aspect of the process and its control system will now be described in further detail with reference to FIG. 8, wherein a three-phase feed stream or three-phase emulsion stream having a hydrocarbon liquid phase (sometimes referred to as "oil"), an aqueous liquid phase (sometimes referred to as "water") and a gas phase is introduced into a separation system in accordance with the current disclosure. As the three-phase feed stream 840 enters two-phase separator 828, the mechanical float operated trunnion valve (LCV) 830 achieves level control, maintains desired levels and allows the de-gassed fluid stream 844 to flow to three-phase separator 824. The gas phase 842 that is separated in two-phase separator 828 can be let down through a pressure control valve (PCV) 843, which is adjusted from open to close based on monitoring of the pressure upstream of PCV 843. PCV 843 can be set slightly above sales pressure to achieve adequate flow to the sales line. This gas produced can be sold, thus is sometimes referred to as "sales gas."

After the initial degassing of the feed stream is achieved, the remaining three-phase fluid stream 844 flows to first three-phase separator 824 where first three-phase separator 824 separates out the phases individually. As this separation occurs, the gas 846 from first three-phase separator 824 can be let down to flare pressure as there is not sufficient pressure left to enter the sales line. This happens across another pressure control valve (PCV) 847 monitoring the upstream pressure, which can be set at the desired operating pressure of first three-phase separator 824 to achieve optimum separation. PCV 847 holds backpressure on the system and lets down gas to the flare line as pressure increases. This will be referred to as flare gas 846.

The aqueous phase collects at the bottom of first three-phase separator 824 and can be monitored by a weighted displacer level control to detect interface of the oil/water layer. The level control can be a pneumatic type and can deliver a pneumatic direct acting signal to a level control valve (LCV) 849. As the aqueous phase level increases, the level control increases the signal to the level control valve so that the valve opens thus allowing the aqueous phase to dump. This can happen proportionally between level and output. The higher the level, the higher the output signal to the valve to open. The dumped aqueous phase is referred to as produced water 848. The remaining product, which is mostly liquid hydrocarbons or oil, accumulates in the oil bucket of the three-phase separator and can be monitored by another weighted displacer level control to detect the top of the liquid hydrocarbon level. As the liquid hydrocarbon level increases, the level control increases the signal to the level control valve (LCV) 851 so that LCV 851 opens thus allowing this enhanced fluid stream 850 to flow to indirect heater 802. This can happen proportionally between level and output. The higher the level, the higher the output signal to the valve to open. In some embodiments, LCV 851 will include a pressure reducer so that enhanced fluid stream 850 is introduced into indirect heater 802 at a lower pressure.

Since the top of the oil level is in contact with the gas section of first three-phase separator 824, a pneumatic float operated level switch can be installed to block the signal coming from the oil level control to the oil-level control valve. Blocking the signal allows the oil control valve to fail in a closed state so as to assure not to dump gas to indirect heater 802 in the event of a low oil level. This system can be pneumatically interlocked.

In indirect heater 802, enhanced fluid stream 850 from first three-phase separator 824 flows through the water bath heater coil wherein heat from the burner is cross exchanged indirectly from the fire-tube to the bath and then to the enhanced fluid stream. Temperature control is achieved through the burner management system (BMS), not shown. The BMS monitors the temperature of the heated fluid stream 852 exiting indirect heater 802 and adjusts the heat to maintain a desired set point that is calculated to de-gas the enhanced fluid stream to meet RVP after the final stage of separation. The bath temperature is also monitored as a secondary control to the process temperature. This helps to maintain a minimum and maximum bath temperature in the event of no flow. There also can be secondary shutdown devices such as low bath level, high stack temperature and flame failure monitors to shut down the heater for equipment protection. As the heated fluid stream 852 exits indirect heater 802, it has the option to pass through a pressure control valve or a manual bypass valve around the pressure control valve (represented by element 853 but which can be seen in more detail in FIG. 5). If selected to pass through the manual bypass valve, the pressure control valve would close and the heated fluid stream 852 would continue to second three-phase separator 826 at a very low pressure, thus operating on the basis of achieving RVP spec after final separation ("single control"). If the option is selected and the manual bypass valve is closed, then the pressure control valve would hold back pressure on indirect heater 802 and indirect heater 802 would be set to operate on achieving the temperature specification (for example 110° F.) and operating on pressure control by the PCV sensing the upstream pressure so as to open to let heated fluid stream 852 flow to second three-phase separator 826 ("dual control"). This allows the user the option of choosing the type of control specification while maximizing production gains and heat duty.

The final stage of separation happens in second three-phase separator 826. As heated fluid stream 852 enters second three-phase separator 826, entrained gas 854 is flashed off and goes directly to flare at near atmospheric pressure. The remaining fluid stream goes through a final separation internally to remove any residual aqueous phase. The aqueous phase collects at the bottom of second three-phase separator 826 and can be monitored by a weighted displacer level control to detect interface of the oil/water layer. The level control can be a pneumatic type and can deliver a pneumatic direct acting signal to a level control valve (LCV) 857. As the water level increases, the level control increases the signal to level control valve 857 so that the valve opens, thus allowing a second produced water 856 to dump. This happens proportionally between level and output. The higher the level, the higher the output signal to the valve to open. The remaining fluid stream 858 gravity feeds to the oil production tanks 836. Gas 835 from tank 836 is taken to flare. Product 837 can be removed from tank 836.

The above described system and process have the following benefits.

- Reduced heat duty requirements of the heat source due to heating primarily an oil phase.
- Reduced salt deposition on heat source walls. In the case of direct-fired solutions using a fire-tube, this salt deposition has negative heat transfer impacts. It also creates hot spots on the fire-tube, which can eventually lead to fire-tube failure, which is commonly catastrophic and results in damaged equipment and possible injury.
- The indirect heater, which can take the form of a water bath heater, provides heat to the oil through a water bath. The oil traverses a coil, under pressure, immersed in a bath of water and glycol mixture at atmospheric pressure. During a fire-tube failure, leaked glycol/water will flow into the fire-tube not resulting in a catastrophic failure but in a visible cloud and eventually a bath low-level alarm causing a shutdown of the heater. This is not a flammable liquid and will not result in a catastrophic failure.
- During a coil leak/failure, the pressure across the heater will not be maintained, which trips an alarm so that the system is shut down. The dumping of the oil into the water bath will not result in a catastrophic failure.
- The coil can be plumbed to allow for fresh water to be circulated through the system to remove any mild scaling or salt deposition which might occur on the coil. Such a flushing or cleaning system is an improvement on heat treater fire-tubes.
- Use of indirect heat allows for closer proximity of the water bath heater to the separator than is allowed for direct heaters. This proximity of equipment will result in less land use, lower environmental impact, and less heat loss from the heater to the tankage or next stage of separation.
- Application of heat at lower pressure results in lower duty.
- The above system, including use of the above-described three-phase separator, will provide a process which will ensure that 100% liquid is passed to the tank.

PROPHETIC EXAMPLES

In order to illustrate the benefits of a system in accordance with this disclosure, the following calculated prophetic examples have been prepared. In each case, the controls and example are calculated for a three-phase hydrocarbon feed under the conditions indicated in Table 1.

TABLE 1

| | | |
|---|---|---|
| Temperature | ° F. | 80 |
| Pressure | psig | 220 |
| Std Liquid Volumetric Flow | bbl/d | 14026 |

The hydrocarbon liquid phase and gas phase components of the hydrocarbon feed are under the conditions indicated in Table 2 with the composition indicated in Table 3.

TABLE 2

| OIL PHASE AND GAS PHASE | | |
|---|---|---|
| Temperature | ° F. | 80 |
| Pressure | psig | 220 |
| Std Liquid Volumetric Flow | bbl/d | 8026 |

TABLE 3

| Mole Fraction | % |
|---|---|
| Oxygen | 0.000 |
| $H_2S$ | 0.000 |
| Carbon Dioxide | 2.520 |
| Nitrogen | 0.133 |
| Methane | 44.104 |
| Ethane | 12.950 |
| Propane | 11.199 |
| i-C4 | 3.647 |
| n-C4 | 10.339 |
| i-C5 | 0.577 |
| n-C5 | 1.051 |
| 2-Methylpentane | 0.656 |
| 3-Methylpentane | 0.262 |
| n-Hexane | 0.932 |
| 2,2,4-Trimethylpentane | 0.135 |
| Benzene | 0.135 |
| Toluene | 0.628 |
| Ethylbenzene | 0.051 |
| m-Xylene | 0.065 |
| p-Xylene | 0.403 |
| o-Xylene | 0.096 |
| Heptane | 2.323 |
| Octane | 1.891 |
| Nonane | 0.648 |
| Decane | 0.559 |
| Undecane | 0.335 |
| Dodecane | 0.343 |
| Tridecane | 0.394 |
| Tetradecane | 0.303 |
| Pentadecane | 0.351 |
| Hexadecane | 0.260 |
| Heptadecane | 0.196 |
| Octadecane | 0.178 |
| Nonadecane | 0.134 |
| Eicosane | 2.298 |
| Water | 0.000 |

The aqueous liquid phase component of the hydrocarbon feed is under the same temperature and pressure conditions and has a standard liquid volumetric flow of 6000 bbl/d. For all the systems illustrated, it is assumed that the oil product needs to meet a 10.842 psi Reid vapor pressure (RVP).

Control I

Product properties are calculated for a separation system illustrated in FIG. 6. In the system of Control I, direct heat treating and three-phase separation are carried out in a heat treater vessel 603. An initial three-phase feed stream 601 is introduced into heat treater vessel 603 without prior separation treatment. Within vessel 603, feed stream 601 is heated and separated into a sales gas 605, produced water 607 and an enriched stream 609 that has a greater concentration of liquid hydrocarbons than feed stream 601. Enriched stream 609 is depressurized down to near atmospheric pressure at pressure reducer 611. The depressurized stream 613 is then introduced into storage tank 615, where further degassing occurs. Gas 617 from tank 615 is taken to flare. Product 619 can be removed from the tank.

The heat treater vessel is operating at 125 psig with no upstream three-phase separation equipment. The model assumes a line heat loss resulting in 30° F. of heat loss for the fluid between entering line 613 and being taken off as product 619. The product (in stream 609) is depressurized to less than 1 psig (15 psia) downstream of the heat treater and upstream of the storage tank.

Table 4 below shows a comparison of Controls I to V and Example I. Note for Control I, the liquid product 619 is meeting the RVP specification (RVP Exiting Tankage) but the treated fluid entering the storage tank 615 is not (RVP Entering Tankage). Additionally, the system of Control I uses 9.6318e+006 Btu/h to heat the hydrocarbon feed. If additional heat losses occur or condensing of tank vapors occurs, the duty would increase within the heat treater and the amount of recovered oil product commonly decreases.

Control II

Figure 7:
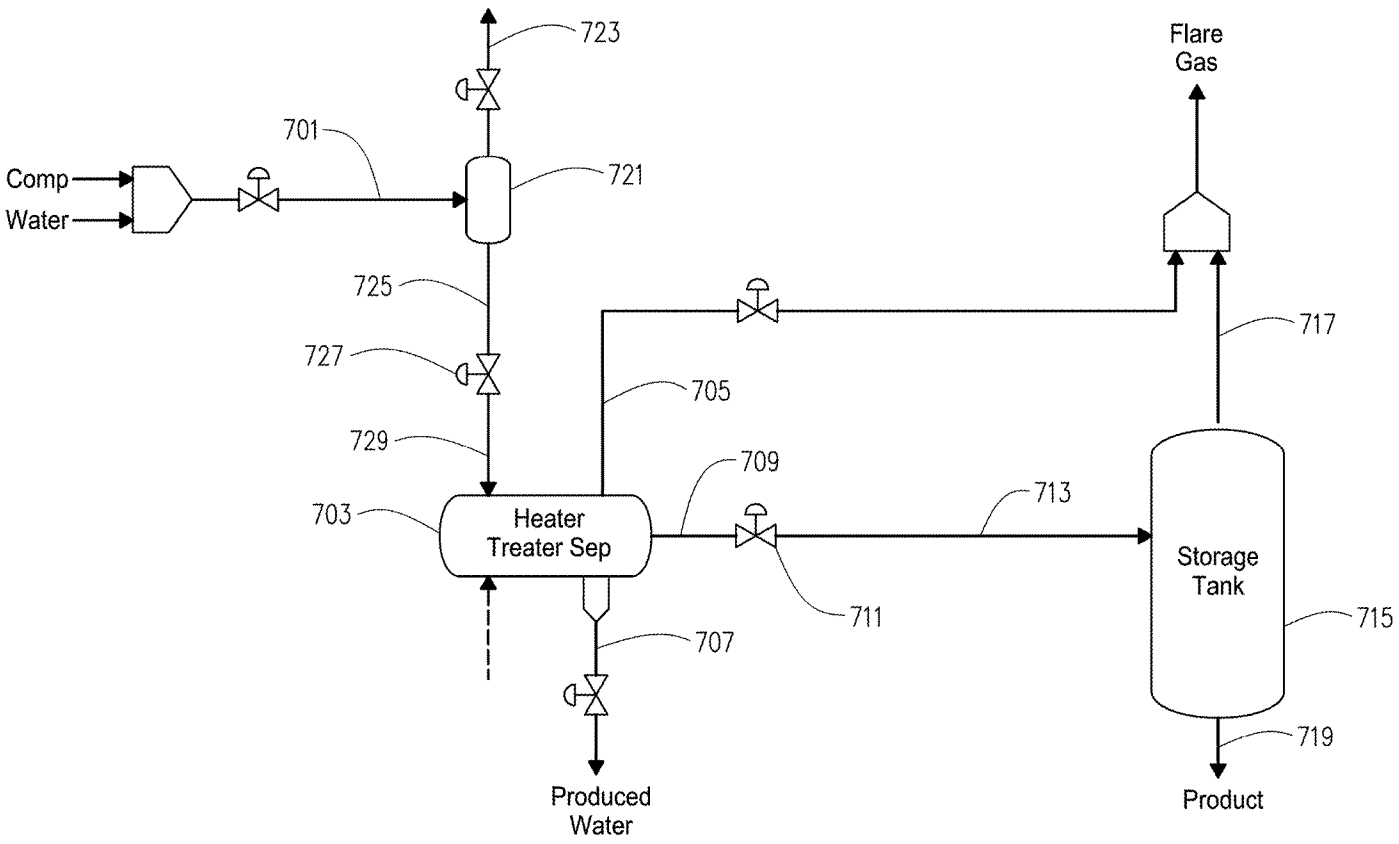
FIG. 7 PRIOR ART
FIG. 7 is a diagrammatic illustration of another prior art system for separation of a hydrocarbon feed stream.

Product properties are calculated for a separation system illustrated in FIG. 7. In the system of Control II, direct heat treating and three-phase separation are carried out in a heat treater vessel 703. An initial three-phase feed stream 701 is introduced into two-phase separator 721. Within two-phase separator 721, sales gas 723 is separated from the liquid stream 725. Liquid stream 725 has a reduced gas content from the initial three-phase feed stream 701. Liquid stream 725 is depressurized at pressure reducer 727 to a mid-pressure stream 729, which is introduced into heat treater vessel 703. Within vessel 703, mid-pressure stream 729 is heated and separated into a gas 705, produced water 707 and an enriched stream 709 that has a greater concentration of liquid hydrocarbons than liquid stream 725. Gas 705 is taken to flare. Enriched stream 709 is depressurized down to near atmospheric pressure at pressure reducer 711. The depressurized stream 713 is then introduced into storage tank 715, where further degassing occurs. Gas 717 from tank 715 is taken to flare. Product 719 can be removed from the tank.

Heat treater vessel 703 is operating at 35 psig with no upstream three-phase separation equipment. Accordingly, the liquid stream 725 undergoes depressurization prior to entering heat treater vessel 703. Subsequently, the enriched stream 709 from the heat treater vessel 703 is again depressurized to less than 1 psig (15 psia). Again, there is an assumed line heat loss resulting in 30° F. of heat loss for the fluid 713 between entering storage tank 715 and being taken off as product 719. The product (in stream 709) is depressurized from 35 psig to less than 1 psig (15 psia) downstream of the heat treater vessel and upstream of the storage tank.

Table 4 shows a comparison with Example I. Note in Control II, the liquid product 719 (RVP Exiting Tankage) is meeting the RVP specification (RVP Exiting Tankage) but the treated fluid entering the storage tank 715 is not (RVP Entering Tankage). Additionally, the system of Control II uses 9.78e+006 Btu/h to heat the hydrocarbon feed.

Control III

The properties are calculated for a system similar to that of Control II except the heater duty is increased to 13.3 MMBTU/hr in order to meet the RVP specification of the oil prior to entering the tankage (RVP Entering Tankage). The results are shown in Table 4. Note that the oil production reduces from 2632.1 bbl/d of oil in Control II to 2,398.6 bbl/d of oil for Control III.

Control IV

Product properties are calculated for a separation system similar to that of Control II, except that the heat treater is operating at 80 psig. Again, there is an assumed line loss resulting in 30° F. of heat loss for product entering the storage tank. The results are shown in Table 4.

For Control IV, the system uses 8.388e+006 Btu/h to heat the hydrocarbon feed. The liquid product exiting the storage tank is meeting the RVP specification (RVP Exiting Tankage) but the treated fluid entering the storage tank is not (RVP Entering Tankage).

Control V

Product properties are calculated for a separation system as per Control IV, except heater duty is increased to 13.6 MMBTU/hr in order to meet the RVP specification of the oil prior to entering the tankage (RVP Entering Tankage). The results are shown in Table 4. Note that the oil production reduces from 2492.5 bbl/d of oil in Control IV to 2,190.7 bbl/d of oil for Control V.

Example I

Product properties are calculated for a separation system in accordance with the current disclosure. The system is illustrated in FIG. 8, described above. In the system of Example I, the indirect heater 802 is operating at less than 1 psig (15 psia). Accordingly, the oil product stream 850 undergoes depressurization prior to entering the indirect heater 802. The system of Example I allows closer proximity of the equipment and greater insulation of the final stages of separation. Accordingly, heat loss in the lines is negligible due to the proximity of the equipment and insulation of the final stages of separation.

Table 4 shows a comparison of Example I with Controls I to V. Note in Example I, the liquid product 837 meets the RVP specification (RVP Exiting Tankage) and the treated fluid 852 entering the storage tank 836 (RVP Entering Tankage) also meets RVP specification. Additionally, Table 4 shows that the system uses 1.5828e+006 Btu/h to heat the hydrocarbon feed, which is substantially less than the heat treater duty required for Control I through Control V. The heat treater duty required here is 16% or less than that in the other cases above. When a vapor pressure specification must be met prior to entering the tankage, this reduces to 12%. Liquid product yields of Example I are equal to that of Control I and II. Moreover, when the RVP specification must be met prior to entering the tankage, the system of Example I provides up to 10% higher volumetric yields than Control I and Control II.

TABLE 4

| Property | Control I | Control II | Control III | Control IV | Control V | Example I |
|---|---|---|---|---|---|---|
| Water produced (bbl/d) | 5971.4 | 5980.6 | 5955.2 | 5967.9 | 5967.9 | 5999.3 |
| Heater Duty (MMBTU/hr) | 9.63 | 9.78 | 13.3 | 8.388 | 13.6 | 1.58 |
| Heater Outlet Temp (F) | 144.65 | 156.27 | 183 | 131.99 | 166.25 | 108 |
| Assumed Line Losses (F) | −30 | −30 | −30 | −30 | −30 | 0 |
| Tankage Product Temperature (F) | 89.737 | 105.59 | 136.33 | 86.144 | 123.75 | 107.24 |
| RVP Entering Tankage (psi) | 16.6127 | 15.155 | 10.842 | 14.394 | 10.841 | 10.842 |
| RVP Exiting Tankage (psi) | 10.842 | 10.841 | 7.1503 | 10.841 | 6.7624 | 10.842 |
| Gas off in Tankage (MMscfd) | 0.33421 | 0.17174 | 0.13732 | 0.18349 | 0.14133 | 0 |
| Oil Product Flow (bbl/d) | 2516.2 | 2632.1 | 2398.6 | 2492.5 | 2190.7 | 2650.8 |

While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Additionally, where the term "about" is used in relation to a range it generally means plus or minus half the last significant figure of the range value, unless context indicates another definition of "about" applies.

Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A method for separation of an aqueous liquid and a gas from a hydrocarbon feed having a first temperature, wherein the aqueous liquid has a saturation temperature, the system comprising:

separating the hydrocarbon feed such that a first portion of the gas and a first portion of the aqueous liquid are separated at a first pressure from the hydrocarbon feed so as to produce a first hydrocarbon-enriched stream;

indirectly heating the first hydrocarbon-enriched stream at a heating pressure in an indirect heater to a second temperature greater than the first temperature but below the saturation temperature of the aqueous liquid to thus produce a heated hydrocarbon-enriched stream;

separating the heated hydrocarbon-enriched stream so as to separate a second portion of the aqueous liquid and a second portion of the gas from the heated hydrocarbon-enriched stream to produce a second hydrocarbon-enriched stream;

controlling the first pressure by using a first control valve such that the first pressure is maintained above near atmospheric pressure; and controlling the heating pressure by using a second control valve associated with the indirect heater, wherein the first control valve and second control valve cooperate so as to have a first configuration in which the heating pressure is at near atmospheric pressure, and a second configuration where the heating pressure is operated above near atmospheric pressure and the step of separating the heated hydrocarbon-enriched stream is carried out at near atmospheric pressure.

2. The method of claim 1, wherein the step of separating the hydrocarbon feed further comprises:

separating a third portion of the gas from the hydrocarbon feed at a second pressure, wherein both the first pressure and second pressure are maintained above near atmospheric pressure.

3. The method of claim 2, wherein the second pressure is greater than the first pressure.

4. The method of claim 3, wherein the second pressure is greater than 100 psig and the first pressure is below 100 psig but above near atmospheric pressure.

5. The method of claim 1, wherein the steps of controlling the first pressure and controlling the heating pressure comprise:

maintaining the first hydrocarbon-enriched stream at a predetermined level in the step of separating the hydrocarbon feed; and adjusting the heating pressure between the first configuration and second configuration to achieve at least one of predetermined Reid vapor pressure (RVP) specifications and temperature specifications.

6. The method of claim 1, wherein the first pressure is maintained above about 20 psig and in the second configuration the heat pressure is maintained above about 20 psig within the indirect heater.

7. The method claim 1, wherein the step of indirectly heating the hydrocarbon-enriched stream comprises:

introducing hot effluent gases from a burner into a fire-tube at least partially submerged in a bath fluid to thus heat the bath fluid;

contacting the thus heated bath fluid with a coil; and introducing the hydrocarbon-enriched stream into the coil to thus flow through the coil such that the hydrocarbon-enriched stream is heated by the heated bath fluid.

8. The method of claim 7, wherein the step of separating the heated hydrocarbon-enriched stream comprises:

introducing the heated hydrocarbon-enriched stream into a separation zone above a series of baffles such that the heated hydrocarbon-enriched stream encounters the baffles, thus enhancing the separation of the heated hydrocarbon-enriched stream;

subsequently introducing the heated hydrocarbon-enriched stream to a bottom portion of the separation zone such that a hydrocarbon liquid in the heated hydrocarbon-enriched stream rises to a mid-portion of the separation zone and the second portion of the aqueous liquid remains at the bottom of the separation zone;

removing the second portion of the gas from the top of the separation zone;

removing the second portion of the aqueous liquid from the bottom of the separation zone; and removing the hydrocarbon liquid from the mid-portion of the separation zone as the second hydrocarbon-enriched stream.

9. The method of claim 8, wherein the steps of controlling the first pressure and controlling the heating pressure comprise:

maintaining the first hydrocarbon-enriched stream at a predetermined level in the step of separating the hydrocarbon feed; and adjusting the heating pressure between the first configuration and second configuration to achieve at least one of predetermined Reid vapor pressure (RVP) specifications and temperature specifications.

10. The method of claim 9, wherein the step of separating the hydrocarbon feed further comprises:

separating a third portion of the gas from the hydrocarbon feed at a second pressure, wherein both the first pressure and second pressure are maintained above near atmospheric pressure.

11. The method of claim 10, wherein the second pressure is greater than the first pressure.

12. The method of claim 11, wherein the second pressure is greater than 100 psig and the first pressure is below 100 psig but above near atmospheric pressure.

13. The method of claim 12, wherein the first pressure is maintained above about 20 psig and in the second configuration the heat pressure is maintained above about 20 psig within the indirect heater.

* * * * *